US010472720B2

(12) United States Patent
Lawless

(10) Patent No.: US 10,472,720 B2
(45) Date of Patent: Nov. 12, 2019

(54) REDUCTION OF CHROMIUM WASTE IN AN ALUMINUM CONVERSION COAT PROCESSING LINE

(71) Applicant: The Boeing Company, Chicago, IL (US)

(72) Inventor: Lawrence M. Lawless, Chesterfield, MO (US)

(73) Assignee: The Boeing Company, Chicago, IL (US)

( * ) Notice: Subject to any disclaimer, the term of this patent is extended or adjusted under 35 U.S.C. 154(b) by 100 days.

(21) Appl. No.: 15/588,846

(22) Filed: May 8, 2017

(65) Prior Publication Data

US 2017/0241022 A1 Aug. 24, 2017

Related U.S. Application Data

(63) Continuation of application No. 13/961,096, filed on Aug. 7, 2013, now Pat. No. 9,683,293.

(51) Int. Cl.

| | |
|---|---|
| ***C23C 22/04*** | (2006.01) |
| ***C23C 22/78*** | (2006.01) |
| ***C23C 22/37*** | (2006.01) |
| ***C23C 22/73*** | (2006.01) |

(52) U.S. Cl.

CPC ..... *C23C 22/04* (2013.01); *C23C 22/37* (2013.01); *C23C 22/73* (2013.01); *C23C 22/78* (2013.01)

(58) Field of Classification Search

None

See application file for complete search history.

(56) References Cited

U.S. PATENT DOCUMENTS

| | | | |
|---|---|---|---|
| 2,867,514 | A | 1/1959 | Newhard et al. |
| 2005/0194262 | A1 | 9/2005 | Heimann et al. |
| 2009/0311534 | A1 | 12/2009 | Griffin et al. |
| 2010/0203327 | A1 | 8/2010 | Inoue et al. |
| 2011/0300406 | A1 | 12/2011 | Dees |
| 2012/0037494 | A1 | 2/2012 | Vacheron |

*Primary Examiner* — Shamim Ahmed
*Assistant Examiner* — Bradford M Gates
(74) *Attorney, Agent, or Firm* — Coats & Bennett, PLLC

(57) ABSTRACT

The present disclosure relates generally to the field of conversion coating. More specifically, the present disclosure relates to improved methods for improving efficiency of chromium conversion coat processing lines.

15 Claims, 2 Drawing Sheets

REDUCTION OF CHROMIUM WASTE IN AN ALUMINUM CONVERSION COAT PROCESSING LINE

This application is a continuation of prior U.S. patent application Ser. No. 13/961,096, filed 7 Aug. 2013, issued Jun. 20, 2017 as U.S. Pat. No.: 9,683,293, the disclosure of which is incorporated by reference herein in its entirety.

TECHNOLOGICAL FIELD

The present disclosure relates generally to the field of conversion coatings and conversion coating processing. More specifically, the present disclosure relates to methods for improving efficiency of aluminum conversion coating processing lines, by reducing chromium-bearing waste water.

BACKGROUND

The term "conversion coating," as used in the metal finishing industry, refers to the conversion of a metal's surface into a surface that will more easily accept applied coatings and/or provide for a more corrosion resistant surface. These coatings are typically thin (not more than 600 nm thick on aluminum), quickly and easily formed, and, if used to enhance paint adhesion, conversion-coated shortly before painting to prevent intermediate degradation of the conversion coating.

Conversion coatings for aluminum have been in use since the early 1920s, and there are a number of different products on the market. Hexavalent chromium-based conversion coating systems have been used for more than 60 years because they have provided superior corrosion resistance and paint adhesion characteristics when used with aluminum and its alloys. Electrolytically generated, or anodized aluminum oxide surfaces have long been used to give the highest quality and range of aluminum oxide-based conversion coatings. However, this quality comes at a cost in terms of time, money and effort.

In most metal processing procedures (painting, conversion coating, anodizing, etc.), an important step is the proper cleaning of the metal surfaces prior to processing. Cleaning removes surface oils and loose dirt from the substrate surface. In general, alkaline cleaners have been used to provide superior results.

Deoxidation refers to the removal of oxides and other inorganics, that would otherwise interfere with further processing of the aluminum, without significant attack upon the aluminum surface. To prevent excessive attack, deoxidizers generally contain an oxidizing agent designed to maintain a thin film of oxide on the metal's surface. This allows for the oxide to be removed, rather than having a direct attack on the metal substrate by the deoxidizer.

The best deoxidizers for aluminum are those based on nitric acid coupled with another oxidizer, such as, for example, hydrogen peroxide or sodium bromate, etc. Unlike other acids, nitric acid will dissolve aluminum oxide but has very little effect upon aluminum itself. Chromic acid and/or chromates have been used in deoxidizers in conjunction with nitric acid and are generally preferred. However, in addition to the toxicity issue associated with the use of hexavalent chromium, such chromium-based deoxidizers leave a thin deposit of chromium oxides on the metal's surface.

Most commonly used conversion coats contain chromium, fluorine, and often contain proprietary additives. The conversion coats operate at a pH ranging from about 1-2.

When the freshly deoxidized and rinsed aluminum substrate is immersed in the conversion coat, there is an acidic attack at the interface of solution and substrate. This raises the pH of the solution at the interface, allowing chromium to precipitate. The conversion coating consists of layers of increasingly rich chromium compounds. The treated metal usually will have a clear to light gold, iridescent finish. The coating is quite hard and scratch resistant, and withstands temperatures up to the melting point of the aluminum, and will not degrade over time.

Hexavalent chromium-based conversion coating systems have been used widely with aluminum (and its alloys) because they have provided superior corrosion resistance and paint adhesion characteristics when used with aluminum and its alloys. However, the discovered toxicity of hexavalent chromium has imposed additional regulatory concerns now requiring additional safety and waste treatment procedures for processing. In addition, the handling, storage and disposal of hexavalent chromium waste increases the overall cost for conversion coating processing lines.

SUMMARY

The present disclosure relates to a method for reducing the amount of chromium rinse water and waste produced in a chromium-containing conversion coating processing line comprising the steps of cleaning a substrate having a substrate surface, rinsing the substrate surface, and immersing the substrate into a deoxidizing solution to deoxidize the substrate surface prior to conversion coating. The substrate is then withdrawn from the deoxidizing solution and immersed into the chromium-containing conversion coating solution without the conventional intervening rinse step. The substrate preferably comprises an aluminum-containing component. To prolong the life of the conversion coating bath, a suitable base may be added to the conversion coating bath in an amount to maintain the pH of the conversion coating bath from about 1 to about 2.

The present disclosure further relates to a method for reducing the amount of rinse water produced in a chromium-containing conversion coating process comprising the steps of preparing a substrate having a substrate surface for immersion into a deoxidizing solution, immersing the substrate into a deoxidizing solution to deoxidize the substrate surface, and removing the substrate from the deoxidizing solution. The substrate is then immersed into and removed from a dead rinse, followed by immersing the substrate into and removing the substrate from a chromium-containing conversion coating solution. To prolong the life of the conversion coating bath, a suitable base may be added to the conversion coating bath in an amount to maintain the pH of the conversion coating bath from about 1 to about 2.

It is understood that the step of preparing a substrate for conversion coating comprises an initial cleaning step and rinsing step. The preliminary cleaning step preferably comprises immersing the substrate into an alkaline solution selected from the group including Turco 42I5NC-LT, Ridoline 298, Oakite 166, Isoprep 44, and combinations thereof. The deoxidizing solution comprises a chromium-containing compound and an inorganic acid, such as, for example, nitric acid. The chromium-containing compound releases chromium ions into solution. The chromium-containing compound in the deoxidizing solution may be selected from a compound such as Isoprep 161, Clepo 180-S, Oakite 34, with Henkel Deoxidizer 6 being particularly preferred. Generally, these deoxidizers contain chromium (usually in the form of chromic acid), an inorganic acid (usually nitric acid) and a source of fluorine.

The conversion coating solution comprises a chromium-containing compound, such as, for example, Permatreat 684, Chromicoat L25, Alodine 1200 with MacDermid Iridite 14-2 being particularly preferred. Generally, these conversion coats contain chromium (usually in the form of chromic acid) and a source of fluorine.

According to the present disclosure, it is shown that no rinsing between the deoxidizing and conversion coat processing steps is necessary. Deoxidizing solution, which is present on the substrate, is "dragged" directly into the conversion coat tank. The concentration of the deoxidizing solution present in the conversion coating solution continues to increase as the processing of substrate material continues. The amount of deoxidizer that can be dragged into the conversion coat may be infinite (0-100%) and acceptable coating will be obtained so long as appropriate chemical adjustment to the conversion coat tank is performed. This mitigates the need to rinse between the deoxidizer and conversion coat tanks and eliminates the production of chromium contaminated rinse water.

The present disclosure further relates to chromium-containing conversion coatings applied to a substrate according to the above-presented method, as well as to the substrates so treated.

Still further, the present disclosure relates to chromium-containing conversion coating baths comprising deoxidizer components from a deoxidizing bath in an amount ranging from about 0 to about 100 percent deoxidizer. Preferably the deoxidizer comprises chromium-containing compounds and nitric acid, inorganic acid, other additives, and combinations thereof.

In a still further variation, the present disclosure relates to components comprising substrates coated according to the described conversion coating baths, as well as any objects comprising such coated components. Such objects include, for example, vehicles, aircraft and stationary structures.

BRIEF DESCRIPTION OF THE DRAWINGS

Figure 1:
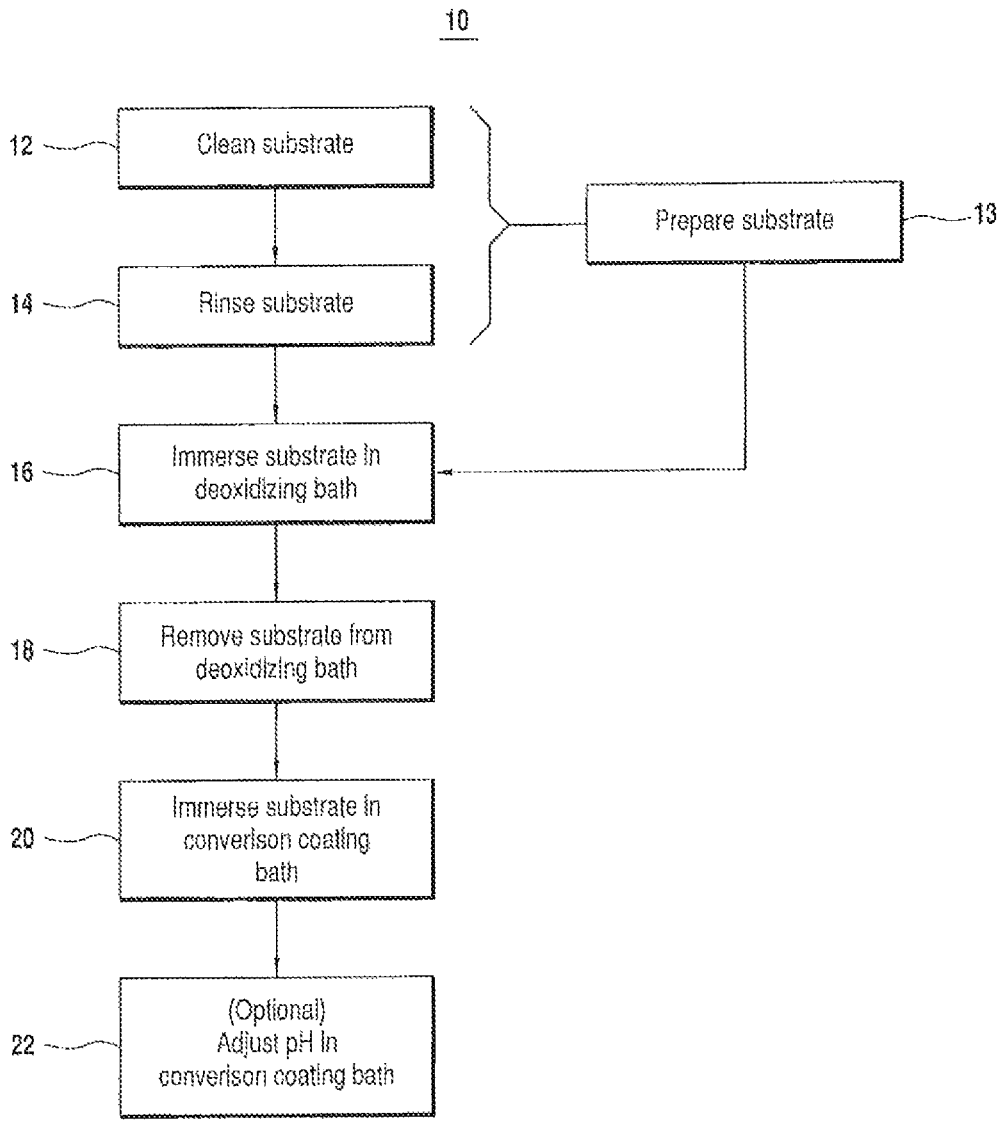
Figure 2:
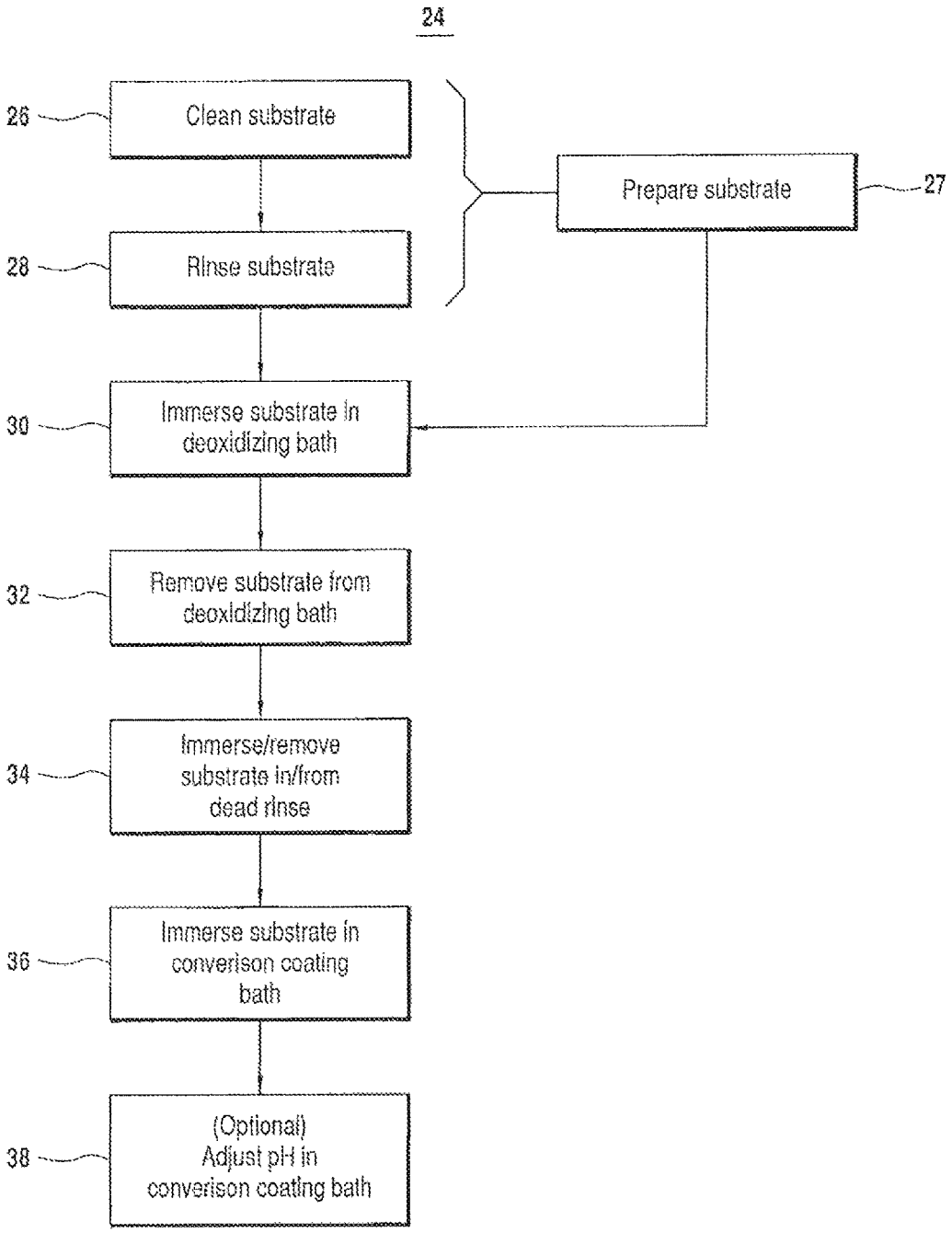

Having thus described variations of the disclosure in general terms, reference will now be made to the accompanying drawings, which are not necessarily drawn to scale, and wherein:

FIG. 1 is a flow chart of a preferred conversion coating process featuring a significantly reduced amount of generated chromium waste; and FIG. 2 is a flow chart of a preferred conversion coating process of FIG. 1 with a "dead rinse" station located between the deoxidizing bath and the conversion coating bath.

DETAILED DESCRIPTION

Traditional chemical processing of metals follows a common pattern: processing, water rinse, processing, water rinse, etc. In the field of conversion coating, water rinse steps are employed throughout the line, especially between the deoxidizing step and the conversion coat step. More specifically, chromium conversion coat processing lines employ water rinse stages that follow a chromium-based deoxidizer and precede the chromium conversion coating of metal substrates (e.g. aluminum, etc.). Such rinse stages collect hexavalent chromium compounds in the rinsing stage that becomes hazardous waste water requiring regulated treatment, storage and disposal. Such rinse steps are universally incorporated into conversion coat processing lines. It has been conventionally thought necessary to maintain chromium-containing conversion baths in as low of a contaminated state as possible to prolong the useful life of the bath, and ensure acceptable coating results relative to a conversion coated substrate.

It has now been recognized that chromium conversion coat processing for aluminum can be significantly streamlined by obviating or eliminating the rinse stages occurring between the chromium-based deoxidizing stage and the chromium conversion coating stage without sacrificing superior coating results. It has now been recognized that in the chromium conversion coat processing line, many deoxidizing and conversion coat steps have three major similarities: both are acidic and both contain hexavalent (hex) chrome and fluorine. It was postulated that a useful conversion coat bath would result and useful conversion coat results could be obtained, even if rinse steps between deoxidizing and conversion coating were eliminated.

To test this possibility, a new 25 liter tank of a chromium based conversion coat (CC) was made up. In an effort to speed testing, this new CC make-up was not aged with dissolved aluminum as specifications normally requires. Five 3".times.6".times.0.032" 2024-T3 bare aluminum panels were used as test specimens in all rounds of testing. These five panels were solvent wiped, alkaline cleaned, rinsed, deoxidized in a proprietary chromium/nitric acid solution and immersed in the CC with no rinsing after deoxidizing. All tanks were aged except for the CC. A final tap water rinse completed processing. The test panels appeared golden in color and somewhat mottled. After 24 hours, the panels were put into a neutral salt fog for 168 hours per ASTM B 117. The panels passed exhibiting less than three pits per panel.

One liter of the new CC was then decanted and disposed of and replaced by one liter of the aged D. One liter of new deoxidizer (D) was made up and put into the D tank. The deoxidizer tank was significantly larger than the CC test tank-85 liters. Five more test panels were then processed as above. The panels passed a 168 hours salt spray exposure. Three more iterations of this procedure were performed. The test panels became increasingly mottled in appearance and finally it seemed as if areas of bare aluminum were apparent. The panels processed during iteration 4 (15% of the CC removed and replaced with aged (D) failed 168 hour neutral salt fog testing.

Analysis of the CC tank was performed and the pH was found to be significantly low; a function of the significantly lower pH of the deoxidizer being added to the conversion coat. Adjustment of the pH was made by adding sodium hydroxide to the CC tank to return the pH of the conversion coat to operating conditions. A new set of test panels were processed as before. Appearance of the panels was excellent. These panels passed 168 hour neutral salt fog testing. Testing continued with the pH being adjusted before test panel processing. Increasing amounts of solution were decanted and replaced in order to speed testing.

The panels processed during run 10 failed salt fog testing. At this point, 40 percent of the conversion coat had been removed and replaced by aged deoxidizer. It was assumed that the conversion coat concentration was too low. A charge of make-up conversion coat material representing 40 percent of the operating volume of the conversion coat was made and the test was repeated. The panels passed neutral salt fog testing.

TABLE 1

| Run | Amt. Decanted and Oxidizer (liters) | % Deoxidizer contained in Conversion Coating (CC) Bath | 168 Hour Salt Fog Results | Notes |
|---|---|---|---|---|
| Baseline | 0 | 0 | Pass | |
| I | I | 4 | Pass | |
| 2 | I | 8 | Pass | |
| 3 | I | 11.6 | Pass | |
| 4 | I | 15.1 | Fail | |
| 4 (Repeat) | | | Pass | pH Adjusted |
| 5 | I | 18.5 | Pass | |
| 6 | I | 21.8 | Pass | |
| 7 | 1.5 | 26.5 | Pass | |
| 8 | 1.5 | 30.9 | Pass | |
| 9 | 1.5 | 35.1 | Pass | |
| 10 | 2.0 | 40.3 | Fail | |
| I0 (Repeat) | | | Pass | Make-up CC add |
| II | 2.0 | 45.1 | Pass | |
| 12 | 2.0 | 49.5 | Pass | Both 168 and 336 hours |
| 13 | | 100 | Pass | |

Wet scribe paint adhesion testing was performed on additional panels processed during runs 8 and 12 per ASTM D3359. The panels passed with no loss of adhesion. Test panels from run 12 were exposed to both 168 and 336 hours of salt spray exposure. The appearance of the panels was excellent and the panels passed at both durations.

After run 12, where the appearance of the test panels was excellent and the panels passed 336 hour neutral salt spray and paint adhesion testing, it was strongly suspected that an even larger amount of deoxidizer could be present in the conversion coat bath without harm. In order of further speed testing, a new tank of deoxidizer (10 liters) was set up. To this new tank was added the initial charge for ten liters of the dry conversion coat material. An adjustment was made by adding sodium hydroxide to the CC tank to raise the operating pH of the conversion coat to 1.3. Bare aluminum panels (2024-T3) were processed both with rinsing between the deoxidizer and conversion coat tanks, and without rinsing between the deoxidizer and conversion coat tanks. After one day of aging, panels were placed in neutral salt spray. Although the panels produced without rinsing had a grey metallic appearance, they passed the 168 hour exposure requirement. This is referred to as Run 13 in the above Data Table.

The "no-rinse scheme", according to methods of the present disclosure, produced acceptable panels having only a slightly different appearance than is commonly obtained with rinsing. Some panels were mottled or cloudy in appearance. Variations in color are acceptable as long as the coating is continuous (which is exhibited by passing salt spray testing). In addition, the pH of the conversion coat progressively decreased due to the more acidic deoxidizer being transferred from the deoxidizing tank into the conversion coat tank, along with an increased amount of metallic contaminants transferred into the conversion coat tank from the deoxidizing tank over time. Nevertheless, contrary to conventional thought, acceptable aluminum panels were surprisingly produced without employing any rinsing of the panels after the deoxidizing step and before the conversion coating step.

FIG. 1 is a flow chart showing one preferred variation of the present disclosure. According to process 10, a substrate is preferably cleaned 12 and rinsed 14, and immersed in a deoxidizing bath 16. Alternatively a substrate is prepared for immersion in the deoxidizing bath 13. It is understood that the "preparing" step 13 may include the cleaning 12 and rinsing 14 steps, and also may include any additional preparatory steps for treating a substrate prior to deoxidizing the substrate. It is further understood that the preparatory step 13 may not specifically include cleaning and rinsing. The substrate is removed from the deoxidizing bath 18 and immersed into the conversion coating bath 20 with no intermediate rinse step. Optionally, to extend the life of the conversion coating bath 20, the pH of conversion coating bath 20 is periodically adjusted 22, preferably with a suitable base.

While significant cost savings in a conversion coat line can be obtained by the methods of the present disclosure by obviating all rinsing of deoxidized aluminum prior to conversion coating, the present disclosure further contemplates a modified "dead rinse" protocol. According to such a "dead rinse" protocol, water rinsing after deoxidizing is still performed but flowing water is eliminated. This results in the virtual elimination of contaminated rinse water (but for the volume of rinse water contained in the "dead rinse" tank, which may be returned to the deoxidizer tank as evaporation allows) and its attendant treatment, further resulting in a significant cost savings as disposal costs are obviated. One significant advantage of employing the dead rinse step into conversion coat processing lines described herein is the improved appearance of the conversion coated aluminum panels.

FIG. 2 is a flow chart showing another preferred variation of the present disclosure incorporating a dead rinse. According to process 24, a substrate is preferably cleaned 26 and rinsed 28, and immersed in a deoxidizing bath 30. Alternatively a substrate is prepared for immersion in the deoxidizing bath 27. It is understood that the "preparing" step 27 may include the cleaning 26 and rinsing 28 steps, and also may include any additional preparatory steps for treating a substrate prior to deoxidizing the substrate. It is further understood that the preparatory step 27 may not specifically include cleaning and rinsing. The substrate is removed from the deoxidizing bath 30 and immersed into and removed from a dead rinse tank 34. The substrate is then immersed into the conversion coating bath 36. Optionally, to extend the life of the conversion coating bath 36, the pH of conversion coating bath 36 is periodically adjusted 38, preferably with a suitable base.

The vast majority of chemical conversion coat processing lines have at least one existing rinse tank following deoxidizing, and most have more than one rinse tank. This results in significant chromium-bearing waste water that requires expensive regulated handling and disposal. However, if the flow of water to such rinse tank(s) were turned off, a so-called "dead rinse" would be created. Use of dead rinses after deoxidizing would impact one aspect of the preferred methods of the present disclosure; namely, reduced processing time. However, incorporating a dead rinse into the methods of the present disclosure would significantly improve the appearance of processed parts and reduce the amount of deoxidizer that is transferred into the conversion coat tank, thereby improving part appearance, pH retention and reducing metallic contamination of the conversion coat tank. It is understood that water would only have to be added to the deoxidizing and dead rinse tanks due to evaporation (as with any processing tank). Therefore, the addition of fresh water to a dead rinse is thought to alleviate any issues of finished aluminum panel appearance, pH control and metallic contaminant drag-in. Compliant salt spray and paint adhesion results will still be obtained without any rinsing so that the use of a dead rinse only insures improved performance.

Additionally, the addition of a buffer to the conversion coat tank will help maintain pH balance in the conversion coat. According to the present disclosure, with the rinsing steps obviated between the deoxidizing and conversion coating steps, residual amounts of both chromic acid and inorganic acid (e.g. nitric acid, etc.) are progressively transferred into the conversion coat from the deoxidizer. Adding a conjugate base of the nitric acid, such as a nitrate based chemical (in the case of nitric acid) to the conversion coat, will help to maintain the pH of the conversion coat tank at a desired level. Two chemicals were tried for pH adjustment of the conversion coating tank: ammonium nitrate and potassium nitrate. The results are shown below. Addition of either improved pH stability as demonstrated by the slope in Tables 2 and 3 below.

TABLE 2

| Mls of 10% HN03 | Control (No Ammonium Nitrate added) pH | 3.3 g/l Ammonium Nitrate Added pH | 8.3 g/l Ammonium Nitrate Added pH |
|---|---|---|---|
| 0 | 1.65 | 1.27 | 1.24 |
| 5 | 1.58 | 1.24 | 1.2 |
| 10 | 1.52 | 1.2 | 1.17 |
| 15 | 1.48 | 1.18 | 1.14 |
| 20 | 1.43 | 1.15 | 1.11 |
| 25 | 1.4 | 1.14 | 1.09 |
| 30 | 1.37 | 1.11 | 1.06 |
| 35 | 1.34 | 1.1 | 1.03 |
| 40 | 1.31 | 1.07 | 1.01 |
| 45 | 1.28 | 1.05 | 0.99 |
| 50 | 1.23 | 1.01 | 0.96 |
| slope | 0.0388 | 0.0241 | −0.0272 |

TABLE 3

| Mls of I0% HN03 | Control (No Potassium Nitrate added) pH | 3.3 g/l Potassium Nitrate Added pH | 8.3 g/l Potassium Nitrate Added pH |
|---|---|---|---|
| 0 | 1.71 | 1.46 | 1.25 |
| 5 | 1.64 | 1.36 | 1.20 |
| 10 | 1.59 | 1.31 | 1.16 |
| 15 | 1.54 | 1.26 | 1.13 |
| 20 | 1.50 | 1.21 | 1.11 |
| 25 | 1.47 | 1.17 | 1.08 |
| 30 | 1.44 | 1.14 | 1.06 |
| 35 | 1.41 | 1.11 | 1.05 |
| 40 | 1.38 | 1.08 | 1.02 |
| 45 | 1.35 | 1.05 | 1.00 |
| 50 | 1.32 | 1.02 | 0.99 |
| slope | 0.0369 | 0.0409 | −0.0248 |

Again, it is important to note that, according to preferred variations, the conversion coat will continue to function adequately, even with a concentration of up to approximately 100% deoxidizer contained in the conversion coat bath. It may be desired to remove the metallic build-up in the conversion coating bath that may also occur due to the elimination of rinse steps. This metallic build-up can be remedied by removing the contaminants in a dead rinse tank(s) following the deoxidizer using an electrolytic technique common to purifying some plating baths known as "dummying". Low voltage can be applied (while not processing any aluminum parts) causing the metallic ions to "plate out" thereby reducing metallic contamination that would be transferred into the conversion coat.

According to the present disclosure, it has been shown that, due to the similar chemistries of a hexavalent chromium-based deoxidizer and a hexavalent chromium conversion coat, the rinse between these two processing steps for aluminum can be eliminated leading to significant savings and advantages. Such advantages include: 1) reduced processing time; 2) reduced water consumption and sewer disposal cost; 3) elimination of a hex chrome waste water stream and its treatment costs; 4) elimination of hex chrome hazardous waste, its disposal costs and long term liability; 5) reduced capital equipment cost (waste treatment); 6) reduced processing line footprint; 7) elimination of need to research alternative technology deoxidizers; 8) reduced conversion coat processing line footprint; and many others. Numbers 3 & 4 above would significantly, cut the hazardous hex chrome waste generated by a typical aluminum conversion coat line, in some cases by as much as 50% or more.

The systems and methods set forth herein are contemplated for use with producing conversion coated components for use in manned or unmanned vehicles or objects of any type or in any field of operation, such as in a terrestrial and/or non-terrestrial and/or marine or submarine setting. A non-exhaustive list of contemplated objects include, manned and unmanned aircraft, spacecraft, satellites, terrestrial, non-terrestrial vehicles, and surface and sub-surface water-borne vehicles, etc., as well as stationary objects.

While the preferred variations and alternatives of the present disclosure have been illustrated and described, it will be appreciated that various changes and substitutions can be made therein without departing from the spirit and scope of the disclosure. When introducing elements of the present invention or exemplary aspects or embodiments thereof, the articles "a," "an," "the" and "said" are intended to mean that there are one or more of the elements. The terms "comprising," "including" and "having" are intended to be inclusive and mean that there may be additional elements other than the listed elements. Although this invention has been described with respect to specific embodiments, the details of these embodiments are not to be construed as limitations.

What is claimed is:

1. A chromium-containing conversion coating applied to a substrate according to a method, the method comprising:

immersing a substrate into a chromium-containing deoxidizing solution to deoxidize the substrate surface;

removing the substrate from the deoxidizing solution;

immersing the substrate into a chromium-containing conversion coating solution;

eliminating production of chromium contaminated rinse water in the chromium-containing conversion coating process; and wherein, without an intervening rinse step, the substrate is withdrawn from the deoxidizing solution and the substrate is immersed into the chromium-containing conversion coating solution.

2. The chromium-containing conversion coating of claim 1, wherein the substrate comprises an aluminum-containing component.

3. The chromium-containing conversion coating of claim 2, wherein the aluminum-containing component comprises an aluminum alloy.

4. The chromium-containing conversion coating of claim 1, where the method further comprises the step of:

maintaining the conversion coating solution at a pH ranging from about 1 to about 2.

5. The chromium-containing conversion coating of claim 4, wherein the pH is maintained by adding a base to the conversion coating solution.

6. A substrate treated with the chromium-containing conversion coating of claim 1.

7. A component comprising the substrate of claim 6.

8. An object comprising the component of claim 7.

9. The object of claim 8, wherein the object is a vehicle.

10. The vehicle of claim 9, wherein the object is selected from the group consisting of: a manned aircraft; an unmanned aircraft; a spacecraft; a satellite; a terrestrial vehicle; a surface water borne vehicle and a sub-surface water borne vehicle.

11. The chromium-containing conversion coating of claim 1, wherein, in the step of immersing the substrate into a chromium-containing conversion coating solution, an amount of deoxidizing solution is transferred into the chromium-containing conversion coating solution.

12. The chromium-containing conversion coating of claim 1, wherein, in the step of immersing the substrate into a chromium-containing conversion coating solution, said chromium-containing conversion coating solution further comprises a conjugate base of nitric acid.

13. The chromium-containing conversion coating of claim 1, wherein, in the step of immersing the substrate into a chromium-containing conversion coating solution, said chromium-containing conversion coating solution further comprises an amount of ammonium nitrate.

14. The chromium-containing conversion coating of claim 1, wherein, in the step of immersing the substrate into a chromium-containing conversion coating solution, said chromium-containing conversion coating solution further comprises an amount of potassium nitrate.

15. The chromium-containing conversion coating of claim 1, wherein the deoxidizing solution comprises chromium ions and nitric acid.

* * * * *